US005952782A

United States Patent [19]

Nanto et al.

[11] Patent Number: 5,952,782

[45] **Date of Patent: *Sep. 14, 1999**

[54] SURFACE DISCHARGE PLASMA DISPLAY INCLUDING LIGHT SHIELDING FILM BETWEEN ADJACENT ELECTRODE PAIRS

[75] Inventors: Toshiyuki Nanto; Hiroyuki Nakahara; Noriyuki Awaji; Masayuki Wakitani; Tsutae Shinoda; Keiichiro Konno; Yasuo Yanagibashi; Naohito Sakamoto, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/689,591

[22] Filed: Aug. 12, 1996

[30] Foreign Application Priority Data

Aug. 25, 1995 [JP] Japan ..... 7-217136
Jul. 22, 1996 [JP] Japan ..... 8-191837

[51] Int. Cl.[6] ..... H01J 17/49

[52] U.S. Cl. ..... 313/584; 313/582; 313/583; 313/586; 313/587

[58] Field of Search ..... 313/584, 586, 313/587, 585, 582, 583, 422, 110, 117

[56] References Cited

U.S. PATENT DOCUMENTS 5,206,746 4/1993 Ooi et al. .
5,240,748 8/1993 Van Esdonk et al. .
5,477,105 12/1995 Curtin et al. ..... 313/466
5,576,596 11/1996 Curtin et al. ..... 313/466
5,595,519 1/1997 Huang et al. ..... 313/466

FOREIGN PATENT DOCUMENTS 55-150526 11/1980 Japan .
60-009029 1/1985 Japan .
04-067534 3/1992 Japan .
04-298936 10/1992 Japan .

OTHER PUBLICATIONS

Shigeki Harada, Takayoshi Nagai, Kanzou Yoshikawa and Masao Karino, *Improvement of Contrast for an AC Plasma Display*, published by 1996 National Convention of the Institute of Electrical Engineers of Japan, held at Waseda University, Tokyo, Mar. 26–28, 1996.

*Primary Examiner*—Sandra O'Shea
*Assistant Examiner*—Mack Haynes
*Attorney, Agent, or Firm*—Greer, Burns & Crain, Ltd.

[57] ABSTRACT

A surface discharge type plasma display panel(PDP) includes a pair of front and rear substrates (11, 21) with a discharge space (30) therebetween and a plurality of pair display electrodes on internal surface of either the front or rear substrate. The display electrodes are extending along each display line L. The PDP further includes a light shielding film (45), having a belt shape extending along the display line direction, formed on either internal or outer surface of the front substrate (11) to overlap each area S2 between the adjacent display lines L and sandwiched between the display electrodes X and Y.

28 Claims, 11 Drawing Sheets

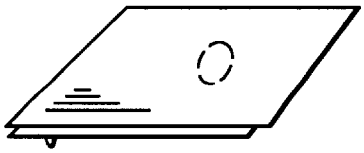
FIG.1A
FIG.1B
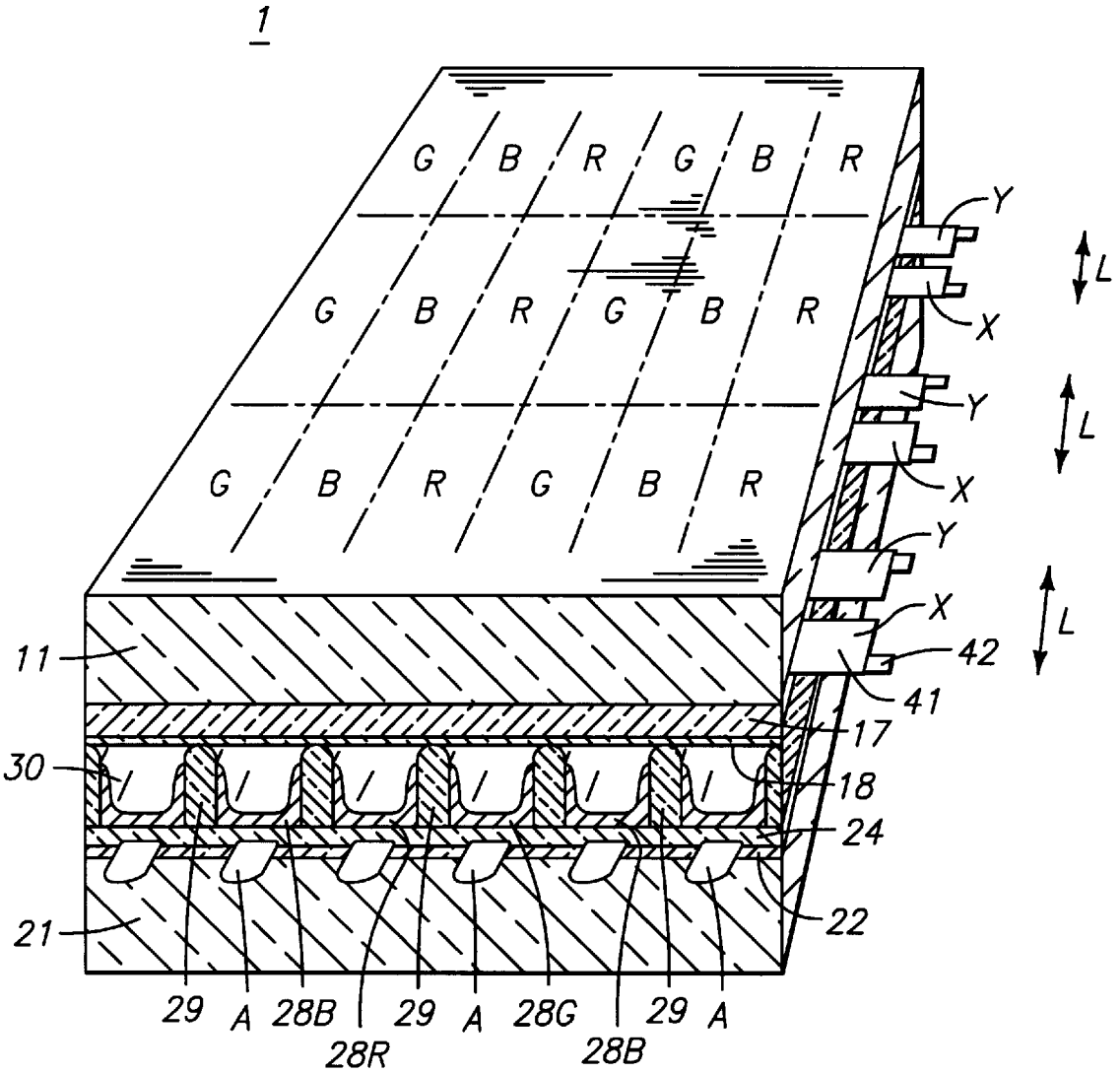

FIRST EMBODIMENT

PLAN VIEW OF LIGHT SHIELDING FILM

FIG.4
FABRICATION OF THE FRONT SUBSTRATE
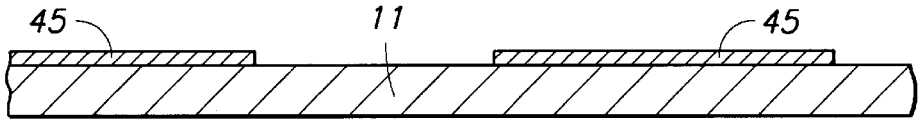
FIG.4A
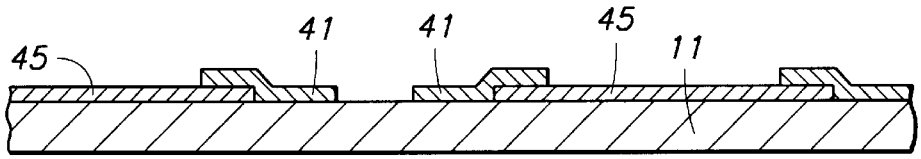
FIG.4B
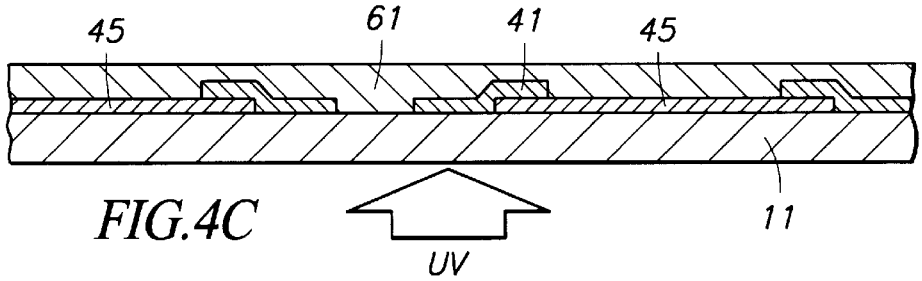
FIG.4C
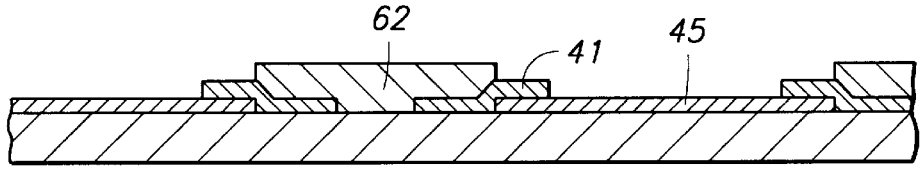
FIG.4D
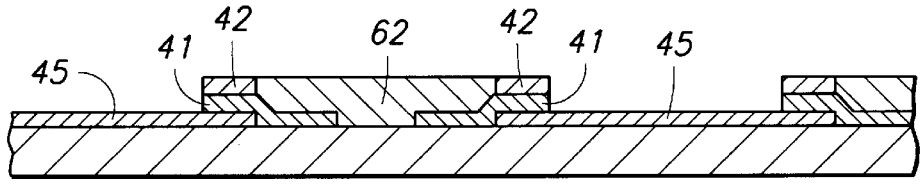
FIG.4E
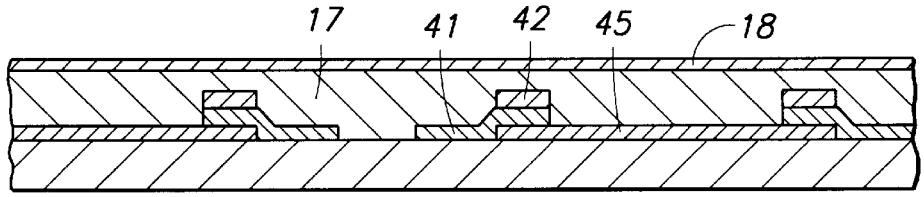
FIG.4F FIG.9
FABRICATION OF THE FRONT SUBSTRATE
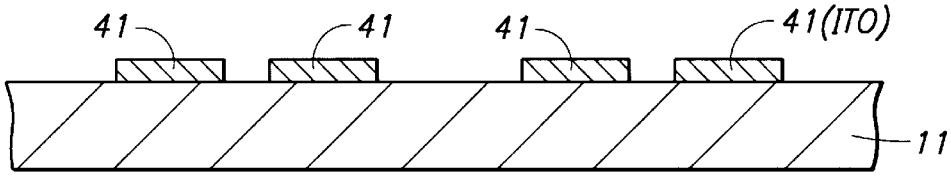
FIG.9A
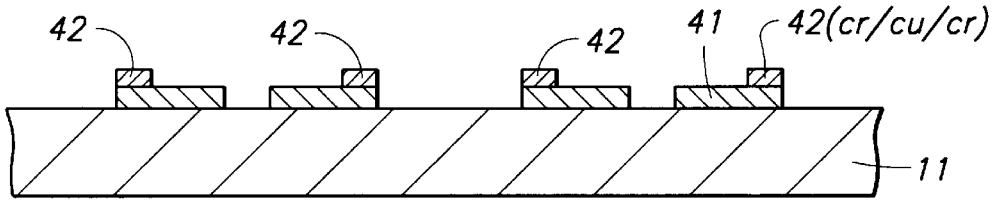
FIG.9B
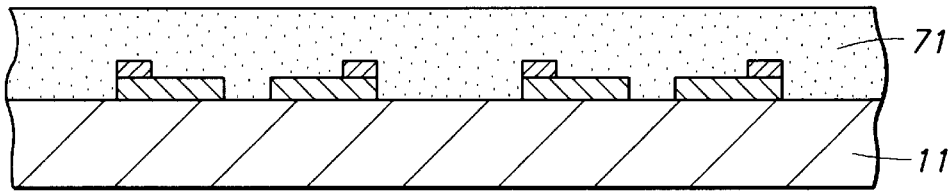
FIG.9C
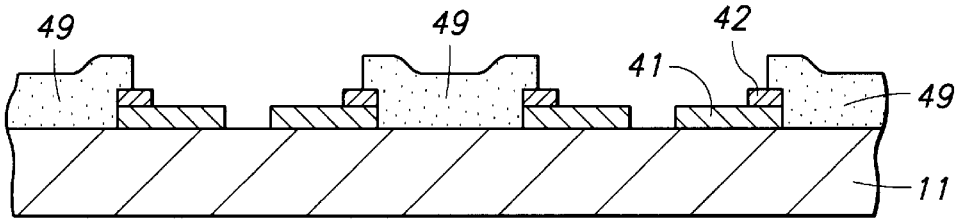
FIG.9D
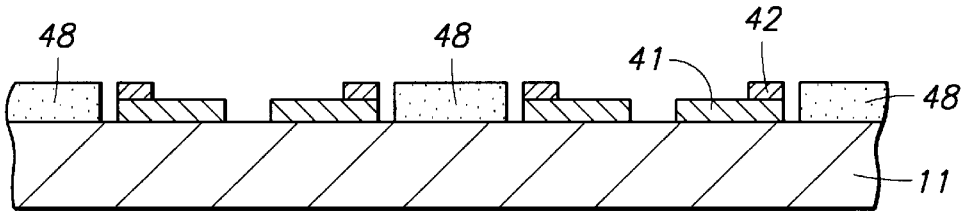
FIG.9E FIG.10
FABRICATION OF THE FRONT SUBSTRATE
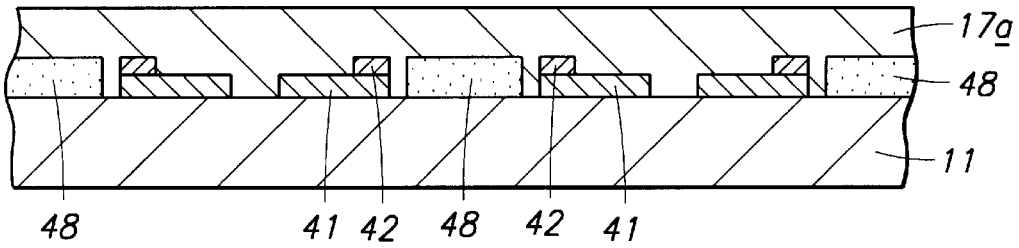
FIG.10A
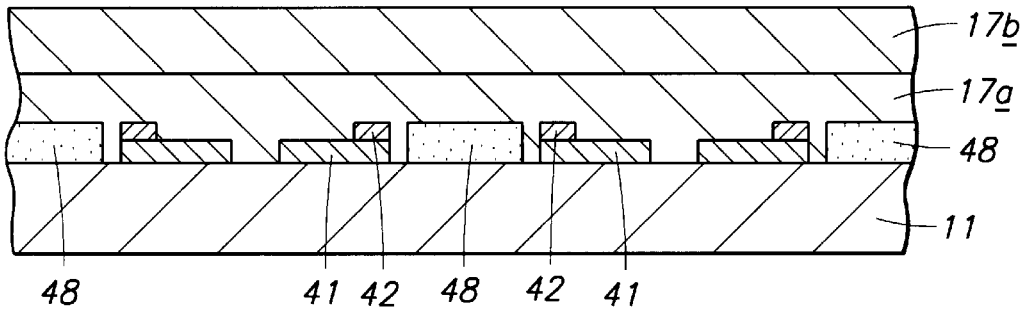
FIG.10B
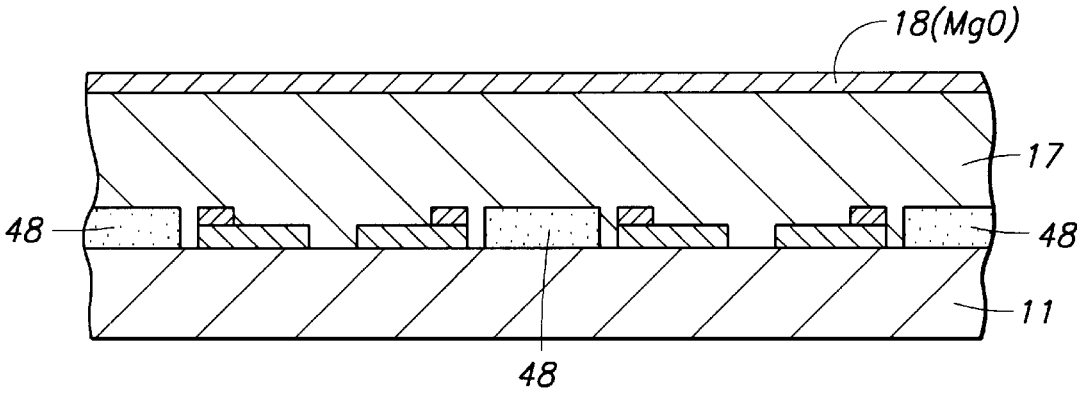
FIG.10C

MODIFICATION

PRIOR ART PDP

SURFACE DISCHARGE PLASMA DISPLAY INCLUDING LIGHT SHIELDING FILM BETWEEN ADJACENT ELECTRODE PAIRS

BACKGROUND OF THE INVENTION

1. Field of the Invention

The present invention relates to a surface discharge plasma display panel (hereinafter referred to as a surface discharge PDP) having a matrix display form, and a method for manufacturing such a plasma display panel.

The surface discharge PDPs are PDPs wherein paired display electrodes defining a primary discharge cell are located adjacent to each other on a single substrate. Since such PDPs can serve adequately as color displays by using phosphors, they are widely used as thin picture display devices for television. And since, in addition, PDPs are the displays that are the most likely to be used as large screen display devices for high-vision pictures, there is, under these circumstances, a demand for PDPs for which the quality of their displays has been improved by increasing resolution and screen size, and by enhancing contrast.

2. Related Arts

FIG. 14 is a cross sectional view of the internal structure of a conventional PDP 90. A PDP 90 is a surface discharge PDP having a three-electrode structure and a matrix display form, and is categorized as a reflection PDP according to the form of its phosphors arrangements.

On the front of a PDP 90, on an internal surface of a glass substrate 11, paired display electrodes X and Y are positioned parallel to each other and arranged for each line of a matrix display so that they cause a surface discharge along the surface of the glass substrate 11. A dielectric layer 17, for AC driving, is formed to cover the paired display electrodes X and Y and separate them from a discharge space 30. A protective film 18 is formed on the surface of the dielectric layer 17 by evaporation. The dielectric layer 17 and the protective film 18 are transparent.

Each of the display electrodes X and Y comprises a wide, linear transparent electrode 41, formed of an ITO thin film, and a narrow, linear bus electrode 42, formed of a thin metal film (Cr/Cu/Cr). The bus electrode 42 is an auxiliary electrode used to acquire an appropriate conductivity, and is located at the edge of the transparent electrode 41, away from the plane discharge gap. With such an electrode structure, the blocking of display light can be reduced to the minimum, while the surface discharge area can be expanded to increase the light emission efficiency.

At the rear, an address electrode A is provided on the internal surface of a glass substrate 21 so that it intersects at a right angle the paired display electrodes X and Y. A phosphors layer 28 is formed on and covers the glass substrate 21, including the upper portion of the address electrode A. A counter discharge between the address electrode A and the display electrode Y controls a condition wherein wall charges are accumulated in the dielectric layer 17. When the phosphors layer 28 is partially excited by an ultraviolet ray UV that occurs as a result of a surface discharge, it produces visible light emissions having predetermined colors. The visible light emissions that are transmitted through the glass substrate 11 constitute the display light.

A gap S1 between paired display electrodes X and Y arranged in a line is called a "discharge slit," and the width w1 of the discharge slit S1 (the width in the direction in which the paired display electrodes X and Y are arranged opposite each other) is so selected that a surface discharge occurs with a drive voltage of 100 to 200 V applied to the display electrodes. A gap S2 between a line of paired electrodes X and Y and an adjacent line is called a "reverse slit," and has a width w2 greater than the width w1 of the discharge slit S1, that is sufficient to prevent a discharge between the display electrodes X and Y that are arranged on opposite sides of the reverse slit S2. Since paired display electrodes X and Y are arranged in a line with a discharge slit S1 between them, and a line is separated from another line by reverse slits S2, each of the lines can be rendered luminous selectively. Therefore, portions of the display screen that correspond to the reverse slits S2 are non-luminous areas or non-display areas, and the portions that correspond to the display slits S1 are luminous areas or display areas.

From the front of a conventional panel structure, a phosphors layer 28 in the non-luminescent state is visible through the reverse slits S2. And the phosphors layer 28 in the non-luminescent state has a white or light gray color. Therefore, when a conventional display panel is used in an especially bright place, external light is scattered at the phosphors layer 28 and the non-luminescent areas between lines has a whitish color, which results in the deterioration of the contrast of the display.

As a method for increasing the contrast for a color display PDP, proposed are a method for providing a color filter by coating the outer surface of the substrate 11 on the front with a translucent paint that corresponds to the luminous color of a phosphors; a method for arranging on the front face of a PDP a filter that is fabricated separately; and a method for coloring a dielectric layer 17 with colors R, G and B.

It is, however, very difficult to apply coats of individually colored paints at locations corresponding to minute pixels. In case of the separate filter on the front, a gap between the PDP and the filter causes distortion in display images. And in case of the coloring of the dielectric layer 17, since the tints of coloring agents (pigments) differ, uniformity of permittivity is deteriorated by coloring, and a discharge characteristic is rendered unstable. In addition, positioning is also difficult when coloring a dielectric layer, just as the coating of colored paints.

SUMMARY OF THE INVENTION

It is therefore one object of the present invention to increase display contrast while rendering unnoticeable non-luminous areas between lines.

It is another object of the present invention to provide an optimal structure for forming a light shielding film including black pigment in non-luminous areas between display lines, and a manufacturing method therefor.

According to the present invention, provided is a surface discharge plasma display panel, wherein paired display electrodes extending along display lines are arranged for each display line on the internal surface of a substrate at the front or in the rear, and wherein a light shielding film having a belt shape extending along the display line direction is formed on the internal surface on the outer surface of the front substrate, so as to overlap each area sandwiched between the adjacent display electrodes.

The area corresponding to a gap (hereinafter referred to as a "reverse slit") between the display electrodes in adjacent lines on a display screen is a non-luminous area. The light shielding film is arranged to correspond with each non-luminous area. Since the plane pattern of the individual shielding films is formed in a belt shape, a striped shielding pattern is formed for the entire display screen. The shielding film blocks visible light that may be transmitted through the reverse slits. Therefore, the occurrence of a phenomenon where non-luminous areas appear bright due to the external light and a leaking light from display lines is prevented so that the display contrast is increased.

Further, according to the present invention, provided is a surface discharge plasma display panel, wherein paired display electrodes are formed for each display line on an internal surface of a front substrate extending along the display lines, and phosphors is deposited on the internal surface of a rear substrate, and wherein a light-shielding film having a darker color than the phosphors with non-luminous condition and having a belt shape extending the display line direction is formed on the internal surface or on the outer surface of the front substrate, so as to overlap each area sandwiched between the adjacent display electrodes.

When viewing the display screen from the front, the phosphors layer is hidden by the shielding film in the non-luminous areas that correspond to the reverse slits.

In addition, according to the present invention, provided is a plasma display panel wherein display electrodes are covered and separated from a discharge space by a dielectric layer, and a light shielding film is located between the front substrate and the dielectric layer.

Furthermore, according to the present invention, provided is a plasma display panel wherein each display electrode comprises a transparent electrode and a metal electrode, which is narrower than the transparent electrode and which overlaps the edge of the transparent electrode at a location close to the non-luminous area, and wherein a light shielding film is located at the front of the display electrode in the substrate facing direction so as to overlap the metal electrodes on both sides of the non-luminous area.

Since the shielding film is also provided on the front of the metal electrode, the deterioration of display quality due to the reflection of external light from the surfaces of metal electrodes can be prevented.

According to a method of the present invention for manufacturing a plasma display panel, the display electrodes and the light shielding film are formed on the front substrate, a coating of dielectric material is applied to form the dielectric layer, and the resultant structure is annealed. This coating and annealing process is performed twice. The thickness of the first coating is selected to be smaller than the second coating.

Since the thickness of the first dielectric coating subject to the first annealing is thin, a floating and moving of the shielding film through the softening of the dielectric material during the first annealing can be minimized so that an unnecessary extending of the shielding film toward the display electrodes to cover them can be avoided.

According to a method of the present invention for manufacturing a plasma display panel, the display electrodes and the light shielding film are formed on the front substrate, a coating of dielectric material is applied to form the dielectric layer, and the resultant structure is annealed. This coating and annealing process is performed twice. The first annealing temperature is set so that it is lower than the temperature at which the dielectric material is softened.

By setting the annealing temperature lower than the softening temperature, the unwanted expansion of the shielding film to cover the display electrodes can be prevented.

Further, according to the present invention, the method for manufacturing a plasma display panel comprises the steps of:

depositing a light shielding material on a front substrate and performing patterning to form a light shielding film;

forming a transparent conductive film on the front substrate on which the light shielding film is formed, and performing patterning to provide a transparent electrode that partially overlaps the light shielding film;

painting a photosensitive material, which is insolubilized by exposure to light, to cover the light shielding film and the transparent electrode, exposing the photosensitive material as a whole from the reverse face of the front substrate and developing the photosensitive material to form a resist layer between the light shielding films; and selectively forming a metal electrode on the exposed portion of the transparent electrode by plating it with a metal film. By using this method, self-alignment of the light shielding film and the metal electrode is performed.

In addition, according to the present invention, provided is a plasma display panel, having a pair of substrates facing each other with a discharge space therebetween, wherein paired display electrodes extending along display lines are formed for each display line on an internal surface of one of the pair substrates so that a discharge is performed between the paired display electrodes; and wherein a light shielding film having a stripe shape and extending along display lines is formed in an area between the display lines and sandwiched between the pair display electrodes on the internal surface of one of the substrates, so that the light shielding film is separated from the display electrodes.

According to another invention, the light shielding film is formed so as to partially overlap over the display electrodes.

With an arrangement wherein the display electrodes are formed first and thereafter the light shielding film is formed, the manufacture of display electrodes using a high vacuum process, such as sputtering, is easily performed.

As a method for manufacturing the device of the above arrangement, provided is a method according to the present invention, for manufacturing a plasma display panel having a pair of substrates facing each other with a discharge space therebetween, comprising the steps of:

forming a plurality of pairs of display electrodes on one of the pairs of substrates to form display lines therebetween;

forming a film containing a dark pigment on the display electrodes on the substrate, and performing patterning of the film so that a stripe-shaped light shielding film, extending along the display lines, is provided in an area between the display lines and sandwiched between the pair of display electrodes; and forming a dielectric paste film on the display electrodes and the light shielding film, and annealing the resultant structure at a predetermined temperature.

BRIEF DESCRIPTION OF THE DRAWINGS

FIG. 1 is a perspective view illustrating the basic structure of a PDP relating to the present invention;

FIGS. 4A through 4F are diagrams illustrating a method for fabricating the front portion of the PDP;

FIGS. 9A through 9E are cross sectional views for explaining a method for manufacturing the PDPs of the second, the fourth and the fifth embodiments of the present invention;

FIGS. 10A through 10C are cross sectional views for explaining a method for manufacturing the PDPs of the second, the fourth and the fifth embodiments of the present invention;

DETAILED DESCRIPTION OF THE PREFERRED EMBODIMENTS

Figure 14:
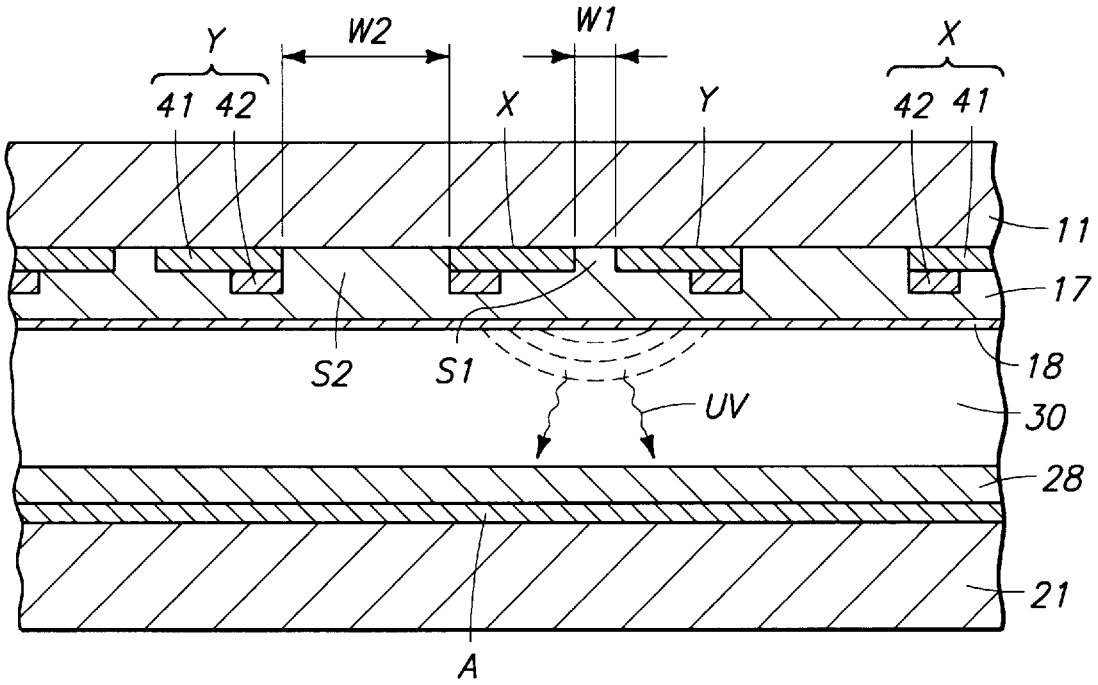
FIG. 14 is a cross sectional view of the essential portion of the internal structure of a conventional PDP.

FIG. 1 is a perspective view illustrating the basic structure of a PDP 1 according to the present invention. The same reference numerals as used in FIG. 14 are also used in FIG. 1 to denote corresponding or identical components, regardless of differences in shapes and materials. The same can be applied for the following drawings.

The PDP 1, as well as the conventional PDP 90, is a surface discharge PDP having a three-electrode structure with a matrix display form that is called a reflection type. The external appearance is derived from paired glass substrates 11 and 21, which face each other with an intervening discharge space 30 therebetween. The glass substrates 11 and 21 are bonded by a seal frame layer (not shown) of a glass having a low-melting point that is formed along the edges of the facing substrate.

A pair of linear display electrodes X and Y in parallel are arranged for each line L of a matrix display on the internal surface of the front glass substrate 11, for the generation of a surface discharge along the substrate surface. The line pitch is, for example, 660 μm.

Each of the display electrodes X and Y comprises a wide, linear transparent electrode 41 formed of ITO thin film and a narrow, linear bus electrode 42 formed of metal thin film having a multi-layer structure. As specific example sizes, the transparent electrode 41 is 0.1 μm thick and 180 μm wide, while the bus electrode 42 is 1 μm thick and 60 μm wide.

The bus electrode 42 is an auxiliary electrode for acquiring appropriate conductivity, and is located at the edge of the transparent electrode 41 away from a surface discharge gap.

For the PDP 1, a dielectric layer for (example PbO low-melting-point glass layer) 17 for AC driving is formed to cover the display electrodes X and Y and separate them from the discharge space 30. A protective film 18 made of MgO (magnesium oxide) for example is deposited on the surface of the dielectric layer 17 by evaporation. The thickness of the dielectric layer 17 is about 30 μm and the thickness of the protective film 18 is approximately 5000 Å for example.

The internal surface of the rear glass substrate 21 is coated with an underlayer 22 of approximately 10 μm, which is ZnO low-melting-point glass for example. Address electrodes A are arranged on the underlayer 22 at constant pitches (for example 220 μm), so that they intersect the paired display electrodes X and Y at a right angle. The address electrode A is produced by annealing silver paste for example, and its thickness is about 10 μm. The underlayer 22 prevents electromigration of the address electrodes A.

The condition of wall electric charge accumulation on the dielectric layer 17 is controlled by a discharge between the address electrodes A and the display electrodes Y. The address electrodes are also covered with a dielectric layer 24 that is formed of low-melting-point glass with the same composition for example as that of the underlayer 22. The dielectric layer 24 at the upper portions of the address electrodes A is about 10 μm thick for example.

On the dielectric layer 24, a plurality of barrier ribs 29, which are about 150 μm high and linear in a plan view, are individually arranged between the address electrodes A.

Then, phosphors layers 28R, 28B and 28C (hereinafter referred to as the "phosphors layers 28," when distinguishing between colors is not especially required), for the three primary colors R (red), G (green) and B (blue) of a full-color display, are formed so as to cover the surface of the dielectric layer 24, including the upper portions of the address electrodes A, and the sides of the barrier ribs 29. These phosphors layers 28 emit light when they are excited by the ultraviolet rays produced by the surface discharge.

The discharge space 30 is defined by the barrier ribs 29 for the units of light emitting areas along the lines (along the arrangement of pixels running parallel with the display electrodes X and Y), and the size of a gap between the discharge space 30 is also defined. In the PDP 1, there are no barrier ribs for defining the discharge space 30 along the columns for a matrix display (along the arrangement direction of the paired display electrodes X and Y or the address lines direction). However, since the size of a gap (the width of a reverse slit) for display lines L, along which the paired display electrodes X and Y are arranged, is set to from 100 to 400 μm, which is sufficiently large compared with the size of a surface discharge gap (the width of a discharge slit) of 50 μm for each display line L, the interference of a discharge does not occur between the lines L.

A display pixel of the PDP 1 comprises three unit light emitting areas (sub-pixels) adjacent each other in each line L. The luminous colors for all the lines L in the same column are the same, and the phosphors layers 28R, 28B and 28C are so provided by screen printing that they are continuously arranged in each column along the address electrode. For this, screen printing provides excellent productivity. Compared with an arrangement wherein the phosphors is divided for each line L, the arrangement of the continuous phosphors layers 28 along a column can easily provide the uniform thickness of the phosphors layers 28 for the sub-pixels.

Figure 2:
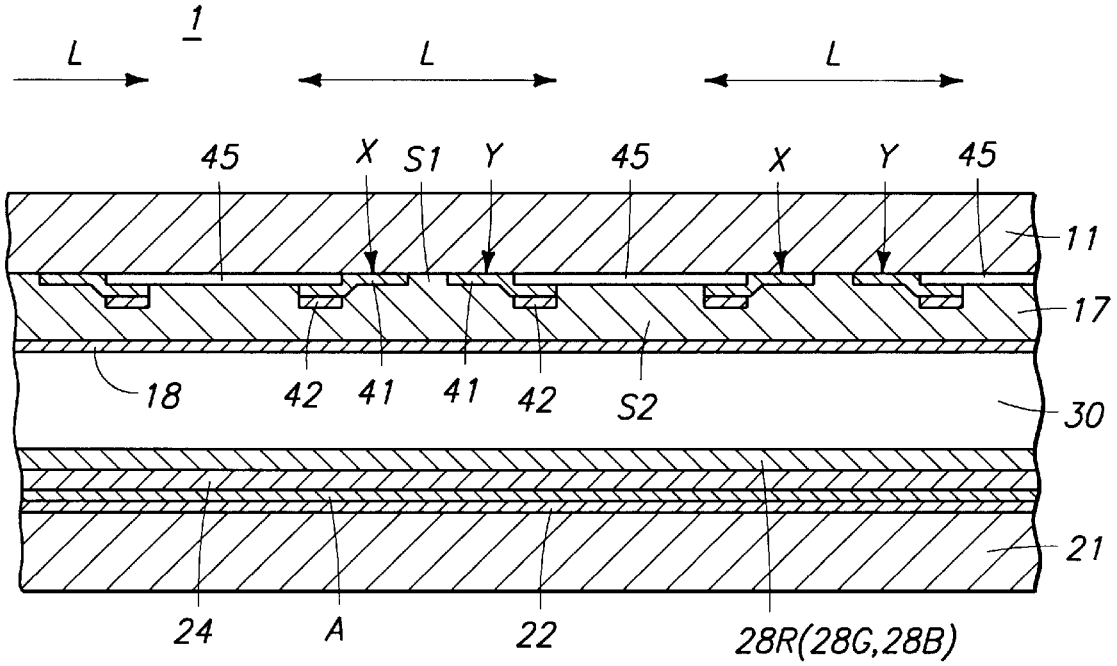
FIG. 2 is a cross sectional view of the essential portion of the PDP according to the first embodiment.
Figure 3:
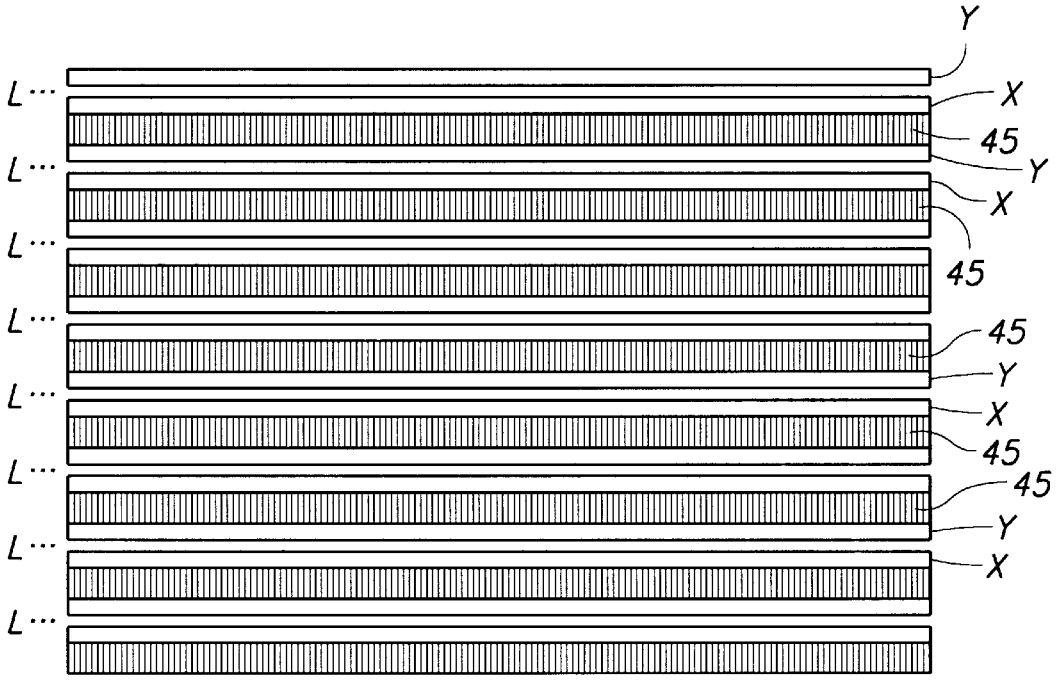
FIG. 3 is a plan view of a light shielding film.

FIG. 2 is a cross sectional view of the essential portion of the PDP 1, and FIG. 3 is a plan view of a light shielding film 45. As is shown in FIG. 2, a light shielding film 45 for blocking (shielding) a visible light is formed for each reverse slit S2, so that the film 45 directly contacts the internal surface of the glass substrate 11. As is shown in FIG. 3, the shielding films 45 are formed in patterns of belts that extend along the display lines, and are located to overlap the areas sandwiched between the display electrodes X and Y of the adjacent lines L. The light shielding films 45 are separated from each other to constitute a striped shielding pattern for an entire display screen so that the phosphors layers 28 are hidden between the display lines L, and the contrast for a display is increased. Since the striped pattern along the display line L does not shift along the display lines L, unlike a matrix pattern surrounding the sub-pixels or pixels, it is easy to align and position the glass substrates 11 and 21 during the manufacturing of the PDP 1.

It is preferable that the top portions of the barrier ribs 29 have the same dark color as that of the light shielding films. A dark lattice pattern is formed by intersecting the barrier ribs and the light shielding films, and the outline of each sub-pixel becomes clear. More specifically, a black color agent, such as chromium (Cr), is mixed with the material for the barrier ribs to provide uniformly dark barrier ribs.

FIGS. 4A through 4F are diagrams illustrating a method for manufacturing the front side portion of the PDP 1. The PDP 1 is produced by providing predetermined components independently for the glass substrate 11 and the glass substrate 21, and by thereafter bonding together the glass substrates 11 and 21 around their circumferences while they are positioned facing each other.

For fabrication of the front portion, first, a dark colored insulating material is deposited on the surface of the glass substrate 11 by sputtering to form an insulation film (not shown) having a surface reflectivity lower than that of the metal electrode 42. Chromium oxide (CrO) or silicon oxide can be used as the insulation material. It is desirable that the thickness of the insulation film be 1 $\mu$m or less in order to reduce the step difference to the transparent electrodes 41. Then, patterning is performed to the insulation film by photolithography using a first light exposing mask, and a plurality of the light shielding film stripes 45 described above are produced at one time (FIG. 4A).

Sequentially, an ITO film is deposited on the glass substrate 11, whereon the light shielding films 45 are formed, and patterning of the ITO film is performed by photolithography using a second light exposing mask. Transparent electrodes 41 are thus formed so that they partially overlap the light shielding films 45 (FIG. 4B).

A negative photosensitive material 61, which is irreversibly solidified by exposure to ultraviolet rays, is coated on the resultant structure so that it covers the light shielding films 45 and the transparent electrodes 41. The photosensitive material is fully exposed to the light from the reverse side of the glass substrate 11 (FIG. 4C). Then, the photosensitive material 61 is developed and forms a resist layer 62 which covers only an area between the light shielding films 45 (FIG. 4D).

Following this, the metal electrodes 42, having a multiple layer structure of, for example, nickel/copper/nickel, are formed on the exposed portions of the transparent electrodes 41 by selective plating (FIG. 4E).

The resist layer 62 is removed, and the dielectric layer 17 and the protective film 18 are deposited in order. The front portion of the PDP 1 is thus produced (FIG. 4F).

In the above described process, the number of required light exposing masks is two (FIGS. 4A and 4B), the same as is required by the fabrication process for the conventional PDP 90, and the number of alignment procedures for the exposing masks is one, also the same as in the conventional process. In other words, according to the fabrication method in FIG. 4, the light shielding films 45 can be formed without deterioration of a yield due to a shift in alignment.

Figure 5:
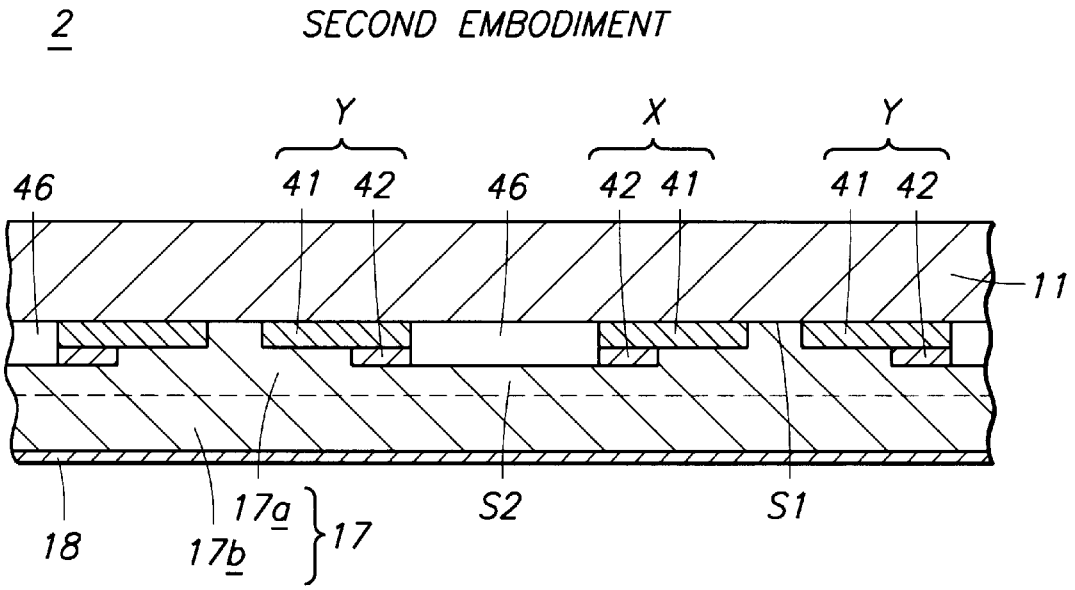
FIG. 5 is a cross sectional view of the essential portion of a PDP according to a second embodiment of the present invention.

FIG. 5 is a cross sectional view of the essential portion of a PDP 2 according to a second embodiment of the present invention, i.e., showing the front portion of a discharge space. In the PDP 2, light shielding films 46 having the same width as the reverse slit S2 are provided on the internal surface of a front glass substrate 11. As well as the light shielding films 45 in FIG. 3, the light shielding films 46 are extended in a belt shape along the display line in a plan view, and constitute a striped light shielding pattern.

For fabrication of the PDP 2, paired display electrodes X and Y are formed on the glass substrate 11. And a black pigment, such as iron oxide or cobalt oxide, that has a heat resistance of 600° C. or higher is printed on the reverse slit area S2 to form the light shielding films 46. Low-melting-point glass is coated and annealed at 500 to 600° C. to produce the dielectric layer 17.

It is preferable that the thickness of the light shielding films 46 be less than the thickness of the individual display electrodes so as to acquire the flat surface of the dielectric layer 17. Further, it is desirable that the dielectric layer 17 be formed in two layers, and that annealing be performed for each layer. More specifically, a comparatively thin coat of low-melting-point glass paste is applied to the substrate and the glass paste is annealed to form a lower dielectric layer 17*a*. Then, another coat of the low-melting-point glass paste is applied to acquire a dielectric layer 17 having the required thickness, and the glass paste is annealed to produce an upper dielectric layer 17*b*. Since the lower dielectric layer 17*a*, which contacts the light shielding layers 46, is formed thin, the migration of a black pigment caused through the softening of the low-melting-point glass during the annealing, can be reduced, and the reduction in luminance due to the unwanted expansion of the light shielding films 46 can be prevented. When the thickness of the lower dielectric layer 17*a* is so set that it is one tenth of or less than the width of the light shielding films 46, the migration of the pigment does not substantially appear.

It should be noted that the unwanted expansion of the light shielding films 46 can also be prevented by setting the temperature for annealing the lower dielectric layer 17*a* to a temperature that is lower than that for softening the low-melting-point glass. In this case, the lower dielectric layer 17*a* and the upper dielectric layer 17*b* can be formed with the same thickness, or the upper dielectric layer 17*b* can be formed thinner than the lower dielectric layer 17*a*.

Figure 6:
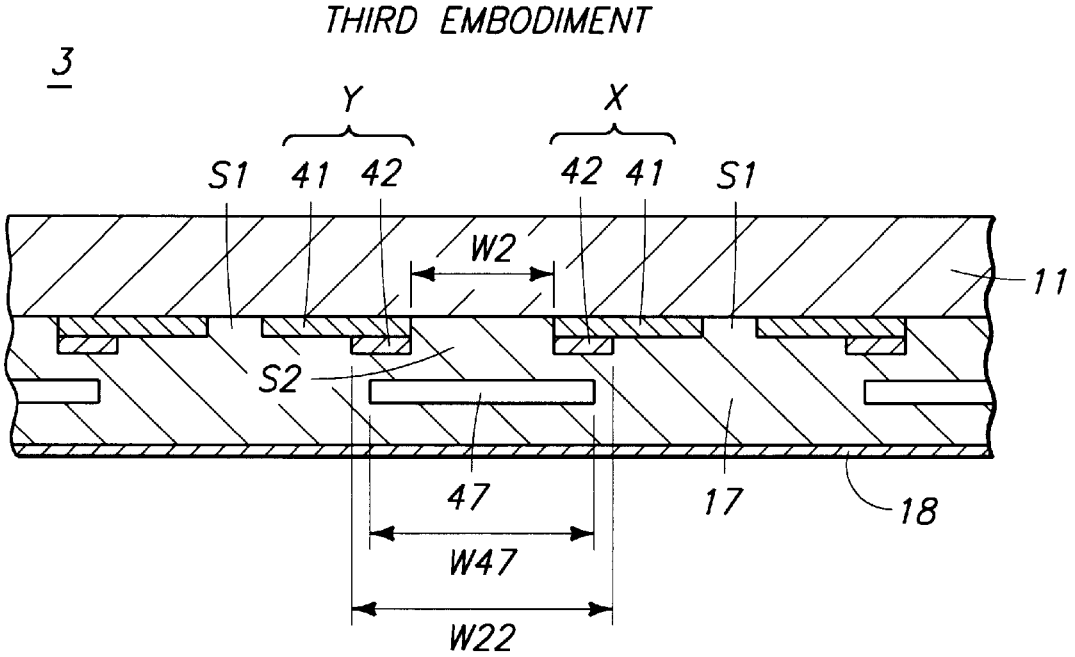
FIG. 6 is a cross sectional view of the essential portion of a PDP according to a third embodiment of the present invention.

FIG. 6 is a cross sectional view of the essential portion of a PDP 3 according to a third embodiment of the present invention, and shows the structure of the front side portion of the discharge space. In the PDP 3, a light shielding film 47 is provided for each reverse slit S2 in an intermediate portion in the direction of the thickness of a dielectric layer 17. The light shielding film 47, as well as the light shielding films 45 in FIG. 3, are extended in a belt shape along the display line in a plan view, and constitute a striped light shielding pattern.

A width w47 of the light shielding film 47 is greater than a width w2 of the reverse slit S2, and is smaller than the interval w22 between the edges, which are closer to the discharge slit S1 , of the metal electrodes 42 sandwiching the reverse slit S2. In other words, the plane size of the light shield film 47 is so selected that it partially overlaps the metal electrodes 42. With this structure, the light shielding film 47 can be easily positioned so that it fully overlaps the reverse slit S2 and does not overlap the light transmitting portion 41 in the display line. It is also important that the light shielding film 47 is apart from the electrodes 41,42.

Figure 7:
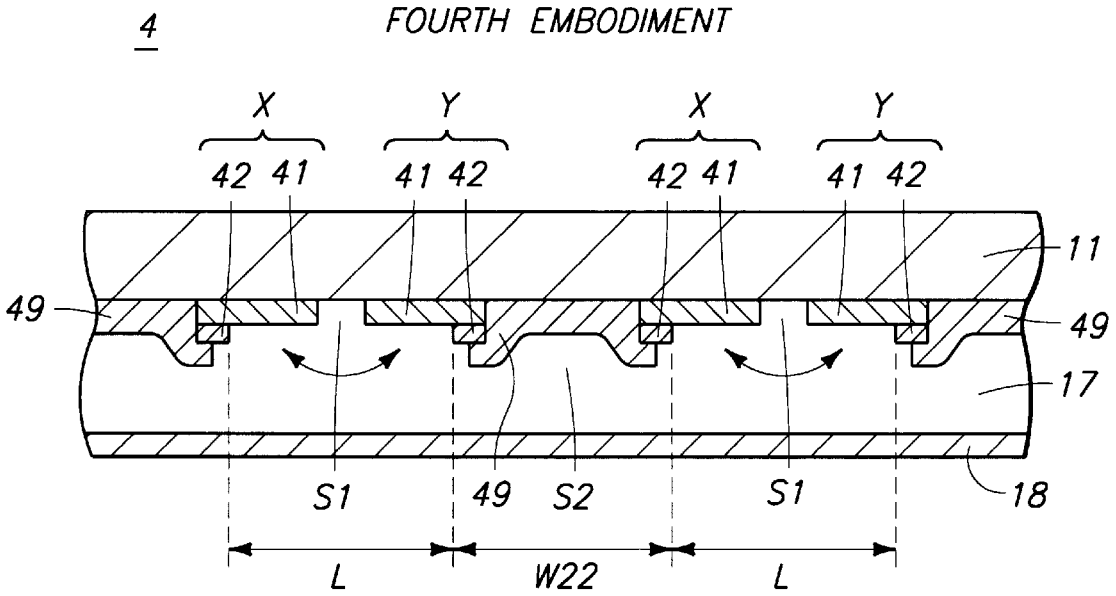
FIG. 7 is a cross sectional view of the essential portion of a PDP according to a fourth embodiment of the present invention.

FIG. 7 is a cross sectional view of the essential portions of a PDP 4 according to a fourth embodiment of the present invention. The light shielding films 45 shown in FIG. 2 are formed between the X and Y electrodes 41 and 42 and the front glass substrate 10. In the PDP 4 shown in FIG. 7, light shielding films 49 are formed inside the reverse slit S2 areas between the X and Y electrodes 41 and 42 so that they partially overlap the X and Y electrodes 41 and 42. This structure is similar to that in FIG. 2 because the light shielding films 49 are so formed that they completely hide the reverse slit S2 areas between the display lines L. However, the manufacturing process for this structure differs from that in FIG. 2 in that the light shielding films 49 containing a black pigment are formed after the X and Y electrodes 41 and 42 are provided. This manufacturing process will be described later in detail.

In the structure of the PDP 4 shown in FIG. 7, it is important for the light shielding films 49 to overlap the electrodes X and Y up to around the middle portions of the bus electrodes 42, which constitute a three-layer structure of Cr/Cu/Cr. In other words, while the bus electrodes 42 provide a higher conductivity for a highly resistant material for the transparent electrodes 41, the electrodes 42 themselves possess light shielding property. When the light shielding films 49 are so formed that they overlap the bus electrodes 42, the portions, except for the display line areas L, are completely shielded.

Figure 8:
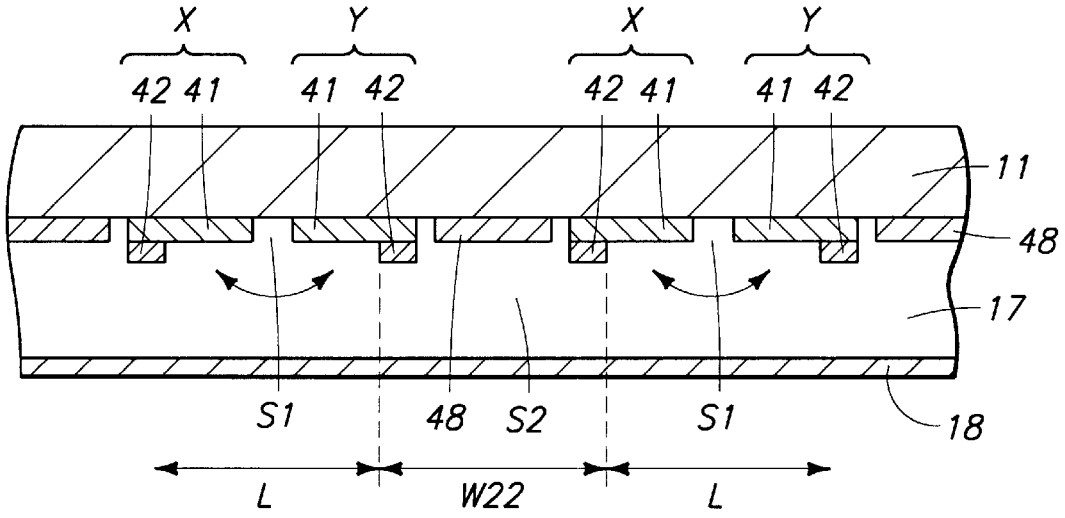
FIG. 8 is a cross sectional view of the essential portion of a PDP according to a fifth embodiment of the present invention.

FIG. 8 is a cross sectional view of the essential portion of a PDP 5 according to a fifth embodiment of the present invention. In the PDP 5, light shielding films 48 are formed between X and Y electrodes 41 and 42 at a certain interval and without making contact with them. When the distance of the non-display areas between the X and Y electrodes 41 and 42 is 500 $\mu$m (using as an example a 42-inch PDP), the light shielding film 48 is formed at an interval of about 20 $\mu$m from the electrodes 41 and 42. This structure is preferable from the view of the manufacturing process for it, even though the gap between the display line areas L is not completely closed. More specifically, as well as with the PDP 4 in FIG. 7, the light shielding films 48 can be formed after the X and Y electrodes 41 and 42 are provided. Moreover, the annealing of the light shielding films 48 can be performed in conjunction with the annealing process for the dielectric layer 17, made of a low-melting-point glass, that is formed on them. Since the light shielding films 48 do not contact the electrodes 41 and 42 in the annealing process at a high temperature, a stable process can be accomplished. This will be described later in detail.

In the structure of the PDP 5 in FIG. 8, since the width of the light shielding films 48 is considerably smaller than the non-display area W22, there is sufficient space so that when the alignment (positioning) of the light shielding films 48 is performed, the films 48 can be easily formed not to overlap the display line areas L.

FIGS. 9A through 9E and 10A through 10C are cross sectional views for explaining a method for respectively fabricating the PDPs of the second, fourth, and fifth embodiments, shown in FIGS. 5, 7 and 8.

As is shown in FIG. 9A, after a silicon oxide film (not shown), for example, is formed as a passivation film on a glass substrate 11, a transparent electrode layer 41 is formed across the entire surface by sputtering. The transparent electrode layer 41 is formed with a thickness of approximately 0.1 $\mu$m by using ITO. Then, in the common lithography procedure, the transparent electrode layer 41 is formed in a striped pattern to provide X and Y electrodes 41 having a width of about 180 $\mu$m.

Sequentially, as is shown in FIG. 9B, a metal layer 42 having a three-layer structure of Cr/Cu/Cr is formed as a bus electrode layer of about 1 $\mu$m on the entire surface by sputtering. The common lithography procedure is performed to pattern the metal layer 42 to approximately 60 $\mu$m. As is previously described, the bus electrode 42 is so formed that it is positioned at the end of the side opposite to the side of the electrode 41 faces each other closely.

For the formation of the X and Y electrodes 41 and 42, sputtering is performed on the glass substrate 11 after it is placed in a high vacuum chamber. Since a light shielding film containing a black pigment, etc., is not formed on the glass substrate 11, the sputtering under a high vacuum can be stably performed.

Then, as is shown in FIG. 9C, a photoresist layer 71 containing a black pigment is formed by screen printing. The black pigment is oxide of manganese (Mn), iron (Fe), or Copper (Cu), for example. Such a pigment is mixed in a photoresist including photosensitive material. For example, a pigment dispersion photoresist (product name: CFPR BK) of Tokyo Ohka Kogyo Co., Ltd. is used.

Following this, as is shown in FIG. 9D, the resultant structure is exposed to light through a predetermined mask pattern, and developed. Then, baking (drying) is performed on the structure for two to five minutes in a dry atmosphere at 120° C. to 200° C., for example, to form the light shielding films 49. In the example shown in FIG. 9D, as for the PDP 4 shown in FIG. 7, the light shielding films 49 are patterned to overlap the X and Y electrodes 41 and 42.

When a different mask pattern is used, the light shielding films 48 can be formed separately from the X and Y electrodes 41 and 42, as is shown in FIG. 9E. This structure corresponds to that of the PDP 5 shown in FIG. 8. Similarly, the light shielding films 46 can be formed as are shown for the structure in FIG. 5.

As is described above, a photosensitive resist of a polymer organic material is used for the light shielding films 49 and 48. If, prior to the formation of the electrodes 41 the light shielding films are formed and annealed for stability, the contact of the electrodes 41 may be deteriorated due to an uneven surface of the film. From this point of view, the process in FIG. 9 is an effective one.

FIGS. 10A through 10C are cross sectional views of a method for forming a dielectric layer 17 and an MgO protection layer 18 on light shielding films. An explanation will be given for this example by employing the light shielding films 48, shown in FIGS. 8 and 9E, that are formed separately from the electrodes 41 and 42.

In the fabrication process for the dielectric layer 17 shown in FIG. 10, annealing of the light shielding films 48 is also performed together with the procedure for annealing the dielectric layer 17. For the formation of the dielectric layer 17, a low-melting-point glass paste containing lead oxide (PbO) as the main element is printed on the surface of the substrate, and is then annealed. This process involves at least two procedures: the printing and the annealing of the lower dielectric layer 17*a* and the upper dielectric layer 17*b*. Specifically, as a material for the lower dielectric layer 17*a*, a composition is selected for which the viscosity is not decreased in the annealing atmosphere and which does not easily react with the ITO of the transparent electrodes 41 and the copper (Cu) of the bus electrodes 42. Such a composition material is, for example, a glass paste that comprises PbO/$SiO_2$/$B_2O_3$/ZnO, and that contains a comparatively large amount of $SiO_2$.

As a material for the upper dielectric layer 17*b*, a composition is selected for which the viscosity is adequately decreased in the annealing atmosphere and the surface is flattened. As such a composition material, a glass paste which comprises $PbO/SiO_2/B_2O_3/ZnO$ and contains a comparatively small amount of $SiO_2$ is selected.

As is shown in FIG. 10A, the surface of the glass substrate 11 is printed by a glass paste, which comprises $PbO/SiO_2/B_2O_3/ZnO$ and contains a comparatively large amount of $SiO_2$. The substrate 11 is then annealed for about 60 minutes in a dry atmosphere at 580° C. to 590° C. The viscosity of the glass paste is not much decreased at the annealing temperature, and the paste does not easily react with the ITO of the transparent electrodes 41 and the copper (Cu) of the bus electrodes 42. Further, the glass paste is annealed at the same time as the light shielding films 48. Therefore, a savings in the time and labor required for the annealing process can be realized, as compared with the example wherein the light shielding films 48 are formed prior to the electrodes 41 and 42.

Next, as is shown in FIG. 10B, the upper dielectric layer 17*b* is formed. In the same manner as for the lower dielectric layer 17*a*, the substrate is printed by using a glass paste and is annealed for about 60 minutes in a dry atmosphere at 580° C. to 590° C. The preferable glass paste is one that comprises $PbO/SiO_2/B_2O_3/ZnO$ and contains a comparatively small amount of $SiO_2$, as is described above. As a result, the dielectric layer 17 having a flat surface is formed.

Finally, a thick layer of low-melting-point glass film for sealing is formed around the edges of the glass substrate 11 (not shown), and then, as is shown in FIG. 10C, the MgO film 18 is formed as a protective film by evaporation.

Although the light shielding films 48 are formed separately from the electrodes 41 and 42 in the process shown in FIG. 10, as previously described, the light shielding films may contact the electrodes 41 as in the PDPs 2 and 4 shown in FIGS. 5 and 7. Though the reason is still not well understood, when a substrate on which light shielding films are in contact with electrodes 41 and 42 is placed in an annealing atmosphere at a temperature close to 600° C., the light shielding films may be turned brown, and to prevent this, it may be effective for the light shielding films to be separated from the electrodes 41 and 42 in the same manner as for the light shielding films 48. The separation interval in this case is called a color change prevention gap for convenience sake.

Figure 11:
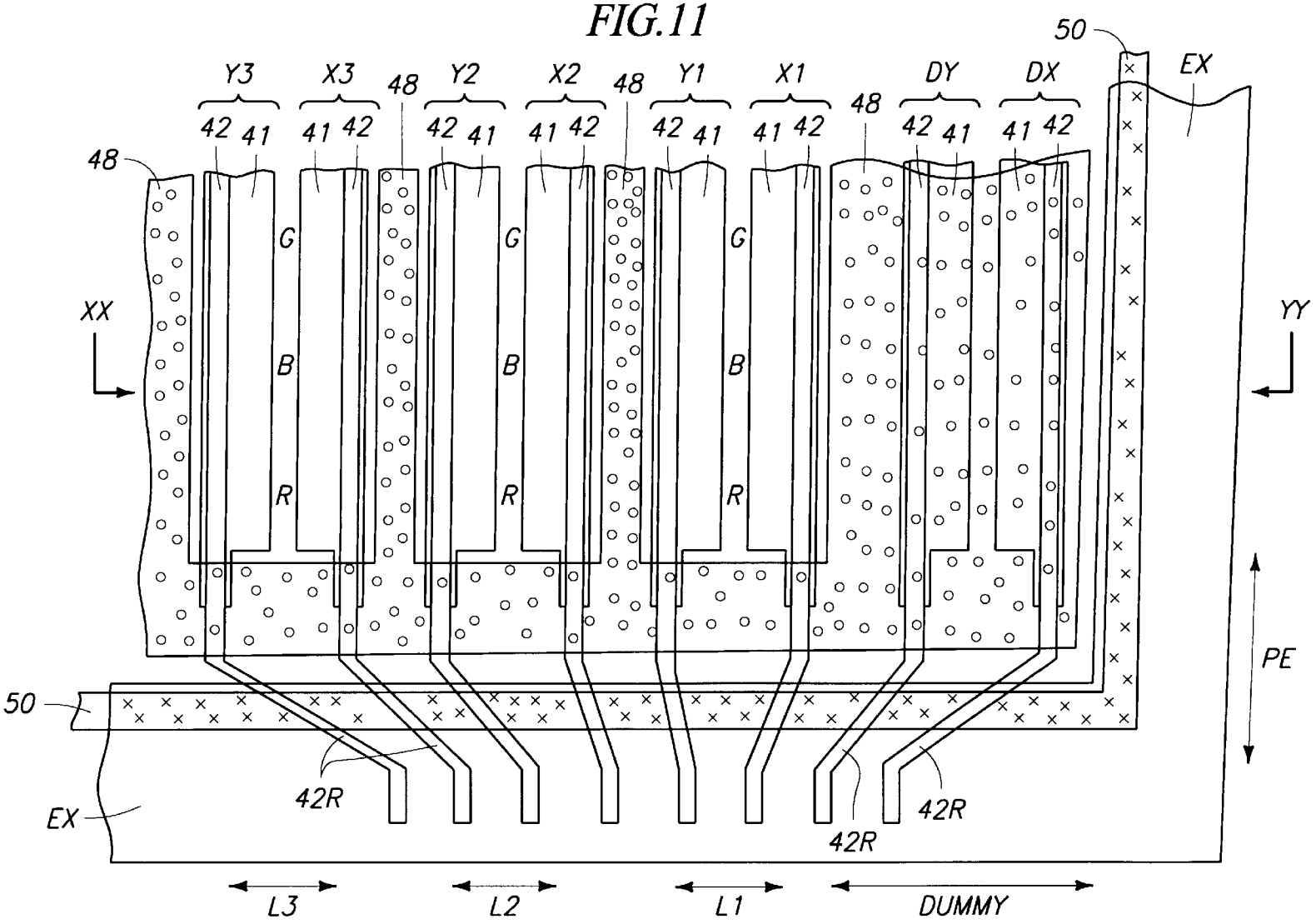
FIG. 11 is a plan view of a PDP wherein a light shielding film is also formed in a periphery of a display area of the panel.
Figure 12:
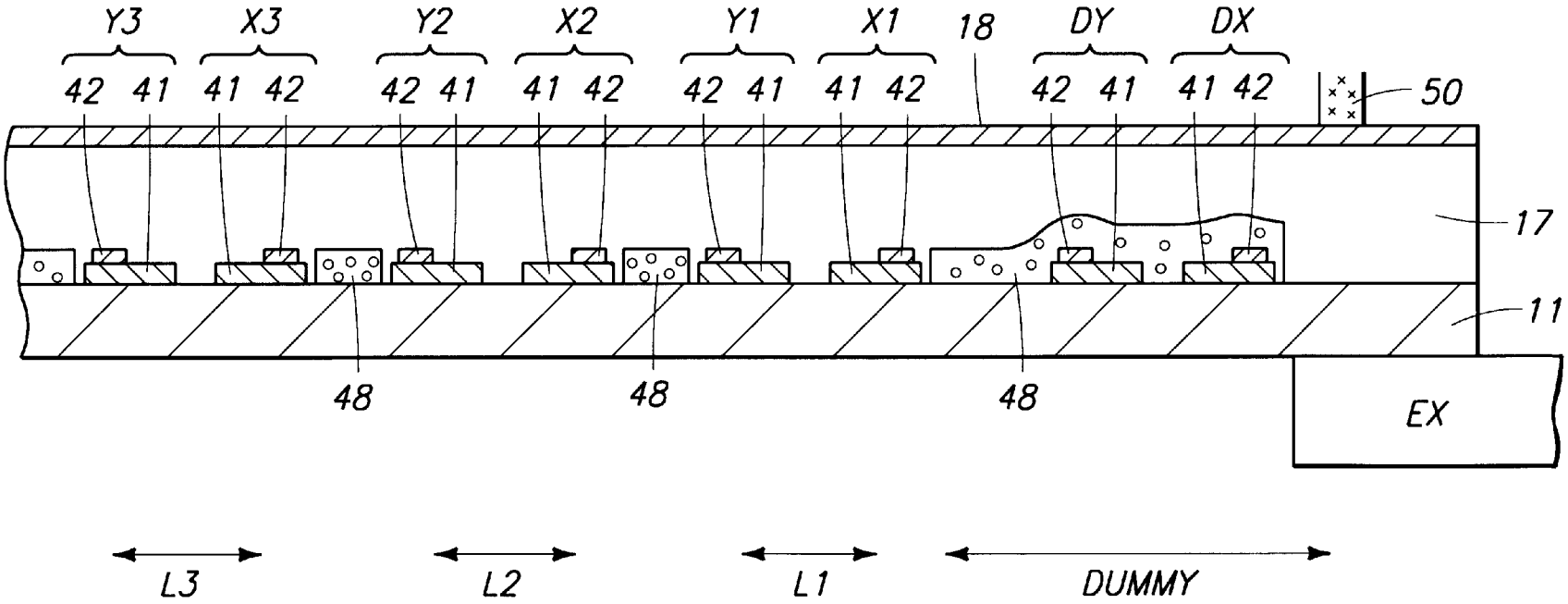
FIG. 12 is a cross sectional view of a portion taken along the line XX–YY in FIG. 11.

FIG. 11 is a plan view of a PDP wherein light shielding films 48 are formed in the periphery outside a display area of the panel. FIG. 12 is a cross sectional view of the portion taken along the line XX–YY in FIG. 11. As is described above, the contrast of a display is increased by forming light shielding films 48 between the X and Y electrodes in the areas between the display lines L1, L2 and L3. In FIG. 11, the light shielding films 48 are also formed in a peripheral area.

In the PDP, to prevent an occurrence of accidental discharge, dummy X and Y electrodes DX and DY, are formed at the peripheral portions of paired X and Y electrodes X1, Y1, X2, Y2, X3 and Y3, which commonly serve as display electrodes. Wall charges not required for display are prevented from being accumulated by frequently performing discharges between the dummy electrodes DX and DY also. The discharges performed in the peripheral area and the exposure of the phosphors layer cause contrast in a display area to be deteriorated. Therefore, as is shown in FIG. 11, the light shielding films 48 are formed on the dummy electrodes DX and DY (indicated as Dummy in FIG. 11), and on a peripheral area PE where leads 42R of bus electrodes 42 are formed. The EX described by the chain lines is a display screen frame on the surface of the panel, and a sealing member 50 is formed at a position on the frame EX to seal the glass substrates. In the cross sectional view in FIG. 12, the front glass substrate 11 and the sealing member 50 formed on the MgO film 18 are shown, while a rear glass substrate is omitted.

The leads 42R of the bus electrodes 42 are connected to an external controller via a flexible cable (not shown). Therefore, the two glass substrates are sealed together by the sealing member 50 at the portion of the leads 42R of the bus electrodes 42.

[Material for light shielding film]

An explanation has been given for the process for forming the dielectric layer 17 on the light shielding films 48 for annealing them at about 600° C., as is shown in FIGS. 10A through 10C. If the display electrodes and the light shielding films are in contact with each other, the black color of the light shielding films 48 may be changed. Although the reason is not well understood, it seems that the display electrodes and the light shielding films that are in contact with each other tend to be ionized during the annealing process, and the low-melting-point glass paste absorbs oxygen from the oxides of Mn, Fe and Cu, which are contained in the black pigment, and the oxides are reduced. Thus, an effective means to prevent the color change is for an oxide agent actively discharging oxygen to be mixed in the photosensitive resist 71 containing the black pigment, which is formed into the light shielding films.

The specific oxide agents that were used in this manner are $NaNO_3$, $BaO_2$, etc. And as a result, it was confirmed that no color change occurred, even when the annealing process was completed.

The light shielding films can increase the contrast for a display in the PDP by not leaking light to the exterior from inside the PDP. However, because of the black color, external light is regularly reflected from the phase boundary between the light shielding films 48 and the glass substrate 11, and as a mirror image due to this regular reflection appears, it is sometimes difficult to look at the display screen. Even in the conventional structure in which light shielding films are not formed, the regular reflection between the paired display electrodes occurs on the surface of the address electrodes at the back substrate. To prevent the regular reflection from occurring at the phase boundary between the light shielding films 48 and the glass substrate 11, a low-melting-point glass powder is mixed in the material for the light shielding films.

The low-melting-point glass powder is the same material as the dielectric layer 17, for example, and is contained about 50% in the organic photosensitive resist 71. The organic photosensitive resist 71, therefore, contains a black pigment and a low-melting-point glass powder. Although, as in conventional manner, the regular reflection of external light occurs on the outer surface of the front glass substrate 11, the refractive index of the light shielding film 48 is close to that of the glass substrate 11 at their phase boundary, and accordingly, the reflectivity is reduced to about half. Further, light is absorbed by the black pigment contained in the light shielding films 48, and accordingly, reflected light is also reduced. Therefore, the regular reflection at the display screen is reduced as a whole, and the unclear display due to mirror imaging is improved.

When low-melting-point glass was not mixed in the light shielding films 48, the regular refractive index was approximately 8% (4% at the glass outer surface and 4% at the phase boundary). When low-melting-point glass powder was mixed into the light shielding films 48, regular refractive index was reduced to about 6% (4% at the glass outer surface and 2% at the phase boundary).

As is described above, the light shielding films are formed to increase the contrast for a display screen. For this formation, an oxide agent is mixed in the organic photosensitive resist 71 to prevent a color change from occurring during the annealing process, and the low-melting-point glass is mixed in to prevent regular reflection.

As a method for preventing the change in the color of the light shielding films, proposed is a method wherein the display electrodes are coated with a thin insulation film, such as $SiO_2$ film, to keep the light shielding films from contacting the display electrodes.

Figure 13:
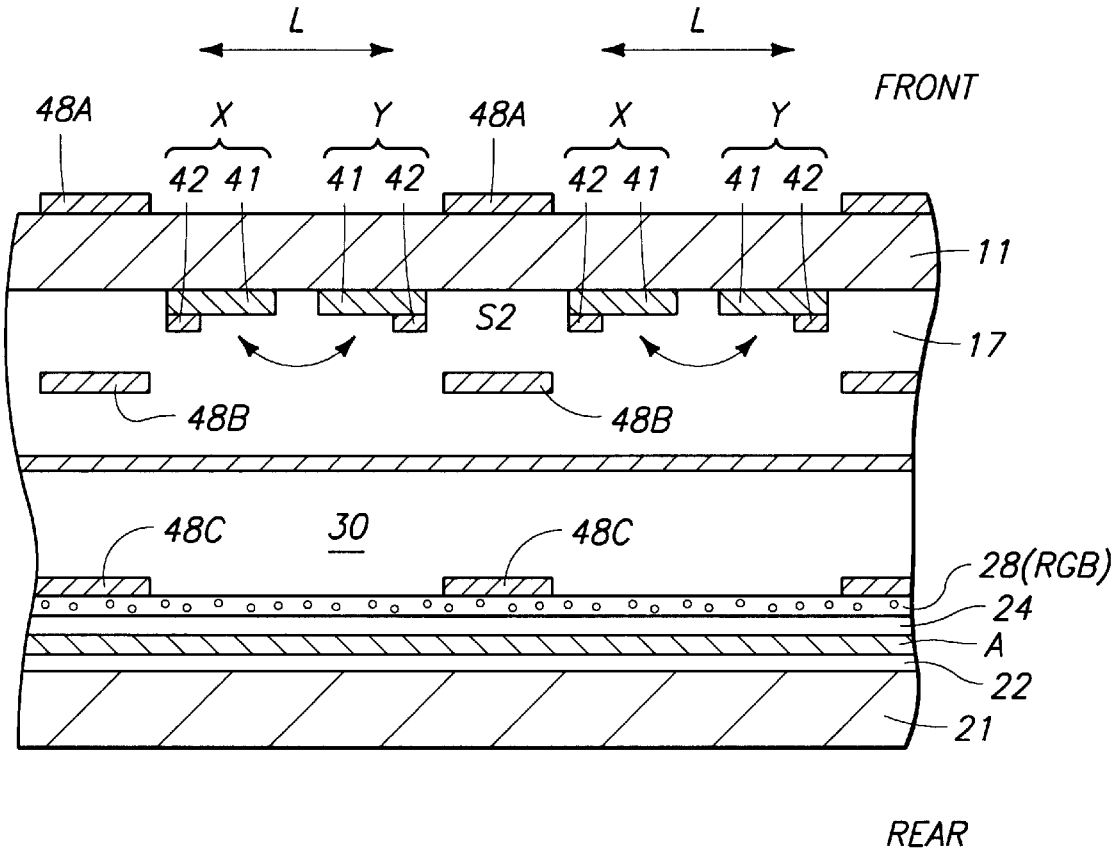
FIG. 13 is a cross sectional view of a modification of the PDP.

FIG. 13 is a cross sectional view of a modification of the PDP, showing a front glass substrate 11 and a rear glass substrate 12. In this modification, as light shielding films 48, light shielding films 48A are formed on the outer surface of the front substrate 11 in the areas between the display lines L; light shielding films 48B are formed inside a dielectric layer 17; and light shielding films 48C are formed above a phosphors film 24 on the rear glass substrate 21.

Regardless of the locations at which the light shielding films 48 are formed, light from the phosphors film 24 can be prevented from leaking out to the front.

Although the reflection PDPs 1 through 5 are employed for the above explanation, the present invention can also be applied for a transmission PDP in which a phosphors layer 28 is formed on a front glass substrate 11. And light shielding films may be formed on the outer surface of the glass substrate 11. It should be noted that in this case, an alignment process between the glass substrates is required.

According to the present invention, non-luminous areas between display lines can be shielded so they are not noticeable, and the contrast for a display can be increased.

According to the present invention, reflection of external light at the surface of a phosphors layer can be prevented, and a display having high contrast can be provided.

According to the present invention, reflection of external light can be prevented not only at the area between the display line but also at the surface of a metal electrode, and a display having high contrast can be achieved.

According to the present invention, expansion of light shielding films is prevented in the process for forming a dielectric layer, and reduction of luminance can be prevented.

According to the present invention, since light shielding films can be formed without increasing the number of mask alignment processes for patterning, a high yield can be maintained and the contrast for a display can be increased.

According to the present invention, after display electrodes are formed, light shielding films and a dielectric layer can be formed and annealed together, and a comparatively stable process can be performed.

What we claim:

1. A surface discharge plasma display panel, having a front substrate and a rear substrate with a discharge space therebetween, and a plurality of pairs of display electrodes extending along each display line and formed on the front substrate, wherein a reverse slit where no surface discharge occurs is defined between each adjacent pair of display electrodes and a discharge slit for surface discharge therebetween is defined between display electrodes of a single pair, and further wherein a plurality of address electrodes are provided on the rear substrate along a direction crossing a direction of extension of the plurality of pairs of display electrodes, the surface discharge plasma display panel further comprising:

a light shielding film for shielding light penetration between the front substrate and the rear substrate, said light shielding film being provided near the reverse slits and being positioned between said front substrate and a phosphors layer.

2. A surface discharge plasma display panel, having a front substrate and a rear substrate with a discharge space therebetween, a plurality of pairs of display electrodes extending along each display line and formed on the front substrate, wherein a reverse slit where no surface discharge occurs is defined between each adjacent pair of display electrodes and a discharge slit for surface discharge therebetween is defined between display electrodes of a single pair, and further wherein phosphors are provided on the rear substrate, the surface discharge plasma display panel further comprising:

a light shielding film for shielding light penetration between the front substrate and the rear substrate, said light shielding film being provided near the reverse slits and being positioned between said front substrate and the phosphors, and said light shielding film having a darker color than the phosphors.

3. The surface discharge plasma display panel of claim 2, further comprising, a dielectric layer formed on the front substrate to cover the display electrodes, wherein the light shielding film is formed between the front substrate and the dielectric layer.

4. The surface discharge plasma display panel of claim 2, further comprising, a dielectric layer formed on the front substrate to cover the display electrodes, wherein the light shielding film is provided at an intermediate portion in the thickness direction of the dielectric layer and is separated from the display electrode.

5. The surface discharge plasma display panel of claim 1, wherein the display electrode includes a transparent layer and a conductive layer, and the light shielding film is made of a dark material including at least one of Mn, Fe and Cu, and is located between the display electrodes and is separated from the display electrodes with a color change preventing gap therebetween.

6. The surface discharge plasma display panel of claim 2, wherein the display electrode comprises a transparent electrode and a metal electrode having a narrower width than the transparent electrode and overlapping the edge of the transparent electrode close to the reverse slit, and the light shielding film is provided on the display electrode to overlap both sides of the metal electrode.

7. A plasma display panel, having a pair of substrates with a discharge space therebetween and a plurality of pairs of display electrodes extending along each display line and formed on an internal surface of one of said substrates wherein a reverse slit where no surface discharge occurs is defined between each adjacent pair of display electrodes and a discharge slit for surface discharge therebetween is defined between display electrodes of a single pair, and further wherein a plurality of address electrodes are provided on another one of said substrates along a direction crossing a direction of extension of the plurality of pairs of display electrodes, the plasma display panel comprising:

a light shielding film for shielding light penetration between the substrates, said light shielding film being provided near the reverse slits and being positioned between said substrate with said display electrodes and a phosphors layer, wherein said display electrodes are provided to partially overlap the light shielding film.

8. A plasma display panel, having a pair of substrates with a discharge space therebetween and a plurality of pairs of display electrodes extending along each display line and formed on an internal surface of one of said substrates, wherein a reverse slit where no surface discharge occurs is defined between each adjacent pair of display electrodes and a discharge slit for surface discharge therebetween is defined between display electrodes of a single pair, and further wherein a plurality of address electrodes are provided on another one of said substrates along a direction crossing a direction of extension of the plurality of pairs of display electrodes, the plasma display panel comprising:

a light shielding film, for shielding light penetration between the substrates, said light shielding film being provided near the reverse slits and being positioned between said substrate with said display electrodes and a phosphors layer, wherein the light shielding film is provided to contact the edges of said display electrodes.

9. A plasma display panel, having a pair of substrates with a discharge space therebetween and a plurality of pairs of display electrodes extending along each display line and formed on an internal surface of one of said substrates, wherein a reverse slit where no surface discharge occurs is defined between each adjacent pair of display electrodes and a discharge slit for surface discharge therebetween is defined between display electrodes of a single pair, and further wherein a plurality of address electrodes are provided on another one of said substrates along a direction crossing a direction of extension of the plurality of pairs of display electrodes, the plasma display panel comprising:

a light shielding film for shielding light penetration between the substrates, said light shielding film being provided near the reverse slits and being positioned between said substrate with said display electrodes and a phosphors layer, wherein the light shielding film is provided apart from said display electrodes.

10. A plasma display panel, having a pair of substrates with a discharge space therebetween and a plurality of pairs of display electrodes extending along each display line and formed on an internal surface of one of said substrates, wherein a reverse slit where no surface discharge occurs is defined between each adjacent pair of display electrodes and a discharge slit for surface discharge therebetween is defined between display electrodes of a single pair, and further wherein a plurality of address electrodes are provided on another one of said substrates along a direction crossing a direction of extension of the plurality of pairs of display electrodes, the plasma display panel comprising:

a light shielding film for shielding light penetration between the bstrates, said light shielding film being provided near the reverse slits and being positioned between said substrate with said display electrodes and a phosphors layer, wherein the light shielding film is provided to partially overlap said display electrodes.

11. A plasma display panel, having a pair of substrates with a discharge space therebetween and a plurality of pairs of display electrodes extending along each display line and formed on an internal surface of one of said substrates, wherein a reverse slit where no surface discharge occurs is defined between each adjacent pair of display electrodes and a discharge slit for surface discharge therebetween is defined between display electrodes of a single pair, and further wherein a plurality of address electrodes are provided on another one of said substrates along a direction crossing a direction of extension of the plurality of pairs of display electrodes, the plasma display panel comprising:

a light shielding film for shielding light penetration between the substrates, said light shielding film being provided near the reverse slits and being positioned between said substrate with said display electrodes and a phosphors layer, said light shielding film being further provided at a peripheral area of an effective display area.

12. The plasma display panel as defined in one of claim 1, 2, 3, 4, 5, 6, 7, 8, 9, 10 or 11, wherein said front or one substrate comprises a glass substrate, and the light shielding film includes the glass material.

13. A surface discharge plasma display panel, having a front substrate and a rear substrate with a discharge space therebetween, wherein said front substrate is transparent and includes a plurality of pairs of parallel display electrodes corresponding to plural display lines on an internal surface thereof, wherein a reverse slit where no surface discharge occurs is defined between each adjacent pair of display electrodes, and said rear substrate includes, on an internal surface thereof, a plurality of address electrodes extending in a direction that intersects the display electrodes, a plurality of barrier ribs provided between adjacent address electrodes, and a phosphors layer having a strip pattern formed between adjacent barrier ribs to cover the address electrodes, said surface discharge plasma display panel comprising:

a light shielding film for shielding light penetration between the front substrate and the rear substrate, said light shielding film being provided near the reverse slits said light shielding film having a darker color than the phosphors;

wherein the barrier ribs include a top portion that is darker than the phosphors, and a lattice-shaped dark pattern is provided by a combination of the light shielding film and the barrier ribs crossing each other to clarify a boundary of plural display points which constitute each said display line.

14. The surface discharge plasma display panel of claim 1, further wherein said light shielding film is of a substantially belt-shaped configuration.

15. The surface discharge plasma display panel of claim 2, further wherein said light shielding film is of a substantially belt-shaped configuration.

16. The plasma display panel of claim 7, further wherein said light shielding film is of a substantially belt-shaped configuration.

17. The plasma display panel of claim 8, further wherein said light shielding film is of a substantially belt-shaped configuration.

18. The plasma display panel of claim 9, further wherein said light shielding film is of a substantially belt-shaped configuration.

19. The plasma display panel of claim 10, further wherein said light shielding film is of a substantially belt-shaped configuration.

20. The plasma display panel of claim 11, further wherein said light shielding film is of a substantially belt-shaped configuration.

21. The surface discharge plasma display panel of claim 13, further wherein said light shielding film is of a substantially belt-shaped configuration.

22. The surface discharge plasma display panel of claim 13, further wherein said light shielding film is positioned between said front substrate and said phosphors layer.

23. A surface discharge plasma display panel, having a front substrate and a rear substrate with a discharge space therebetween, and a plurality of pairs of display electrodes extending along each display line and formed on the front substrate, wherein a reverse slit where no surface discharge occurs is defined between each adjacent pair of display electrodes and a discharge slit for surface discharge therebetween is defined between display electrodes of a single pair, and further wherein a plurality of address electrodes are provided on the rear substrate along a direction crossing a direction of extension of the plurality of pairs of display electrodes, the surface discharge plasma display panel further comprising:

a light shielding film for shielding light penetration between the front substrate and the rear substrate, said light shielding film being provided near the reverse slits and being positioned on an outer surface of said front substrate.

24. The plasma display panel of claim 9, wherein said light shielding film is positioned on said phosphors layer.

25. The surface discharge display panel of claim 3, wherein the light shielding film is separated from the display electrodes.

26. The surface discharge display panel of claim 3, wherein the light shielding film is made of a dark material including at least one of Mn, Fe and Cu.

27. The surface discharge display panel of claim 3, wherein the light shielding film is made of a dark material including at least one of Mn, Fe and Cu, and is kept from contacting the display electrodes through an insulating layer which is formed on the display electrodes.

28. A surface discharge plasma display panel, having a front substrate and a rear substrate with a discharge space therebetween, a plurality of pairs of display electrodes extending along each display line and formed on the front substrate, wherein a reverse slit where no surface discharge occurs is defined between each adjacent pair of display electrodes and a discharge slit for surface discharge therebetween is defined between display electrodes of a single pair, and further wherein phosphors are provided on the rear substrate, the surface discharge plasma display panel further comprising:

a light shielding film for shielding light penetration between the front substrate and the rear substrate, said light shielding film being provided near the reverse slits, and said light shielding film having a darker color than the phosphors, and wherein the display electrode includes a transparent layer and a conductive layer, and further wherein the light shielding film is made of a dark material including at least one of Mn, Fe and Cu, and is located between the display electrodes, and is separated from the display electrodes with a color change preventing gap therebetween.

* * * * *

UNITED STATES PATENT AND TRADEMARK OFFICE

CERTIFICATE OF CORRECTION

PATENT NO. : 5,952,782

DATED : September 14, 1999

INVENTOR(S) : Nanto et al.

It is certified that error appears in the above-identified patent and that said Letters Patent is hereby corrected as shown below:

Column 4, line 57, delete "FIG. 1 is a" and insert -- FIGS. 1A and 1B are-- and delete "view" and insert --views-- therefor Column 4, line 59, after "invention" insert -- where FIG. 1B is an enlarged view of the section enclosed by the dashed line in FIG. 1A-- therefor Column 5, lines 34-35, delete "FIG. 1" and insert --FIGs. 1A and 1B -- therefor

UNITED STATES PATENT AND TRADEMARK OFFICE

CERTIFICATE OF CORRECTION

PATENT NO. : 5,952,782

DATED : September 14, 1999

INVENTOR(S) : Nanto et al.

It is certified that error appears in the above-identified patent and that said Letters Patent is hereby corrected as shown below:

Column 5, line 32, delete "FIG. 1 is a" and insert --FIGs. 1A and 1B are-- and delete "view" and insert --views-- therefor Column 14, line 37, delete "claim 1" and insert --claim 4-- claim 5 should depend from claim 34

Column 15, line 58, delete "bstrates" and insert --substrates-- therefor

Column 17, line 25, delete "9" and insert --7-- therefor.

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*